US007572239B1

(12) United States Patent
Brotz

(10) Patent No.: US 7,572,239 B1
(45) Date of Patent: Aug. 11, 2009

(54) WAVE EXERCISE DEVICE AND METHOD OF USE

(76) Inventor: Gregory R. Brotz, P.O. Box 1322, Shaboygan, WI (US) 53081

( * ) Notice: Subject to any disclaimer, the term of this patent is extended or adjusted under 35 U.S.C. 154(b) by 292 days.

(21) Appl. No.: 10/869,713

(22) Filed: Jun. 16, 2004

Related U.S. Application Data

(63) Continuation-in-part of application No. 10/178,102, filed on Jun. 24, 2002, now abandoned, which is a continuation-in-part of application No. 09/900,831, filed on Jul. 9, 2001, now abandoned.

(51) Int. Cl.
*A61H 7/00* (2006.01)

(52) U.S. Cl. ..... 601/98; 601/148

(58) Field of Classification Search ..... 601/98, 601/148, 149–152, 158, 160, 166
See application file for complete search history.

(56) References Cited

U.S. PATENT DOCUMENTS

| | | | | |
|---|---|---|---|---|
| 3,880,154 | A * | 4/1975 | Gabmeier | 601/157 |
| 3,964,472 | A * | 6/1976 | Nicollet | 601/157 |
| 4,466,141 | A * | 8/1984 | Starkey | 4/488 |
| 5,042,479 | A * | 8/1991 | Brotz | 607/87 |
| 5,105,804 | A * | 4/1992 | Van Nostrand | 606/241 |
| 6,029,294 | A * | 2/2000 | Saringer | 5/600 |
| 6,179,797 | B1 * | 1/2001 | Brotz | 601/150 |
| 6,752,772 | B2 * | 6/2004 | Kahn | 601/98 |

* cited by examiner

*Primary Examiner*—Michael A. Brown
(74) *Attorney, Agent, or Firm*—Muncy, Geissler, Olds & Lowe, PLLC

(57) ABSTRACT

A bath and its method of use are disclosed, such bath containing fluid and producing waves of sufficient size to provide exercise to a user, such bath having areas of movement in its bottom, the sequential movement of which causes such waves to move to cause the user to exercise his or her body by maintaining equilibrium in the bath.

2 Claims, 11 Drawing Sheets

WAVE EXERCISE DEVICE AND METHOD OF USE

This application is a continuation-in-part of my previous application entitled Exercise Bath, Ser. No. 10/178,102 filed Jun. 24, 2002, now abandoned which was a continuation-in-part of my previous application entitled Passive Exercise Bath, Ser. No. 09/900,831 filed Jul. 9, 2001, now abandoned.

BACKGROUND OF THE INVENTION

1. Field of the Invention

The device and method of this invention relate to an exercise bath and more particularly relate to a bath that includes a bathing chamber with means to provide various kinds of wave actions therein along with various bath mediums that can provide passive proprioceptive exercise and therapy to a user.

2. History of the Prior Art

Vibratory baths for use in patient therapy are known in the prior art. The inventor herein, Gregory R. Brotz has a U.S. Pat. No. 5,042,479 for a Therapeutic Vibratory Bath. In this patent a vibratory bath is taught in which vibrations are imparted to the fluid in the bath, which fluids can further contain certain ingredients and which vibrations may be beneficial to the skin of the patients being treated in the bath. The bath of U.S. Pat. No. 5,042,479 provides for higher frequency, low amplitude vibrations to the fluid, and no waves sufficient to move a user are produced by this bath. Any passive exercise provided to the muscles of a patient are from the pressure of water or other fluid directed against the patient. The vibrations in this patent are typically in the high frequency, especially for example in the ultrasonic range for the debridement of skin tissue with the fluid being oxygenated fluorocarbons.

SUMMARY OF THE INVENTION

It is an object of this invention to provide a very different device than that described in the prior art which device is for a very different purpose, being exercise. The device of this invention provides a bath having a flexible bottom on which the user lies in a horizontal position which feature is not found in my prior art bath. Further, the movement provided in the bath of this invention creates actual waves in the body and surface of the water which waves move against the user and propel the user who must then provide passive proprioceptive exercise to resist the wave movement. Nowhere in my prior art bath can a user lie prone on a flat flexible bottom which user is to be moved by wave action. The bottom of the bath contains a plurality of movable members which are controlled to impart various lower frequency and higher amplitude wave patterns to the fluid medium contained within the bath. In the preferred embodiments of the bath of this invention, there can be a plurality of movable members located in the base which can include pneumatic, hydraulic, mechanical, electromechanical or equivalent movement means of cylinders moving discrete panels under the flexible bottom of the bath to create waves of low frequencies and high amplitudes, causing large movement in the fluid contained within the bath in various patterns, which movement promotes instinctive, unconscious proprioceptive reaction by the user to compensate for the user's body movement caused by such wave action and causing the user to engage in passive exercise to resist such wave movement and re-equilibriate his or her body. There are many types of exercise that the user engages in while being moved by the waves, including lateral movements and yawing by placing the hands outward to try to stabilize the body while it is being jostled by the waves and moving the knees up and down to try to accommodate head-to-toe wave action. Other movements are utilized by the user to try to maintain stability during wave action which movements amount to significant exercise.

The bath of this invention can be positioned at a fixed location to be used as an exercise device or massage device. The user can have a hand-held control device or an operator can have access to a control panel to vary the water level, the wave frequency, wave amplitude and wave pattern that are utilized within the bath. Wave patterns can occur in series of sequences such as first one pattern and then another, and then more patterns. Rest periods where there is reduced wave action can occur between sequences of wave patterns.

To utilize the bath of this invention to provide exercise, the user enters the bath and pushes downward with his or her hands for balance, but the wave pattern created affects the water surface and produces currents under the surface which cause the user to become unstable in equilibrium due to wave forces shifting in the user's center of gravity. The user must then move his or her body position to re-equilibriate his or her body to try to maintain a controlled, stable position. The user's need to maintain a controlled position in the bath, although being an almost instinctive unconscious effort, provides passive exercise to the user due to an expenditure of energy by the user which translates into calories burned. Further, when movement of the fluid starts and a wave or sloshing pattern is set up in the bath, the user tries to maintain his or her balance by changing his/her body position or paddling with his/her hands and feet. The wave patterns can vary from end-to-end patterns; side-to-side patterns; one, two and three crest patterns; kitty-cornered patterns and center-to-corner patterns; all of which can be sequenced so that the exercising user is always having to try new ways of maintaining a controlled stable position in the bath. Thus the bath of this invention can act as a muscle exercise device as well as a massage device.

The user's resistance to wave motion creates a proprioceptive muscle exercise. It is felt that the use of the exercise bath of this invention can also help alleviate chronic aches and pains.

DESCRIPTION OF THE PREFERRED EMBODIMENT(S)

Figure 1:
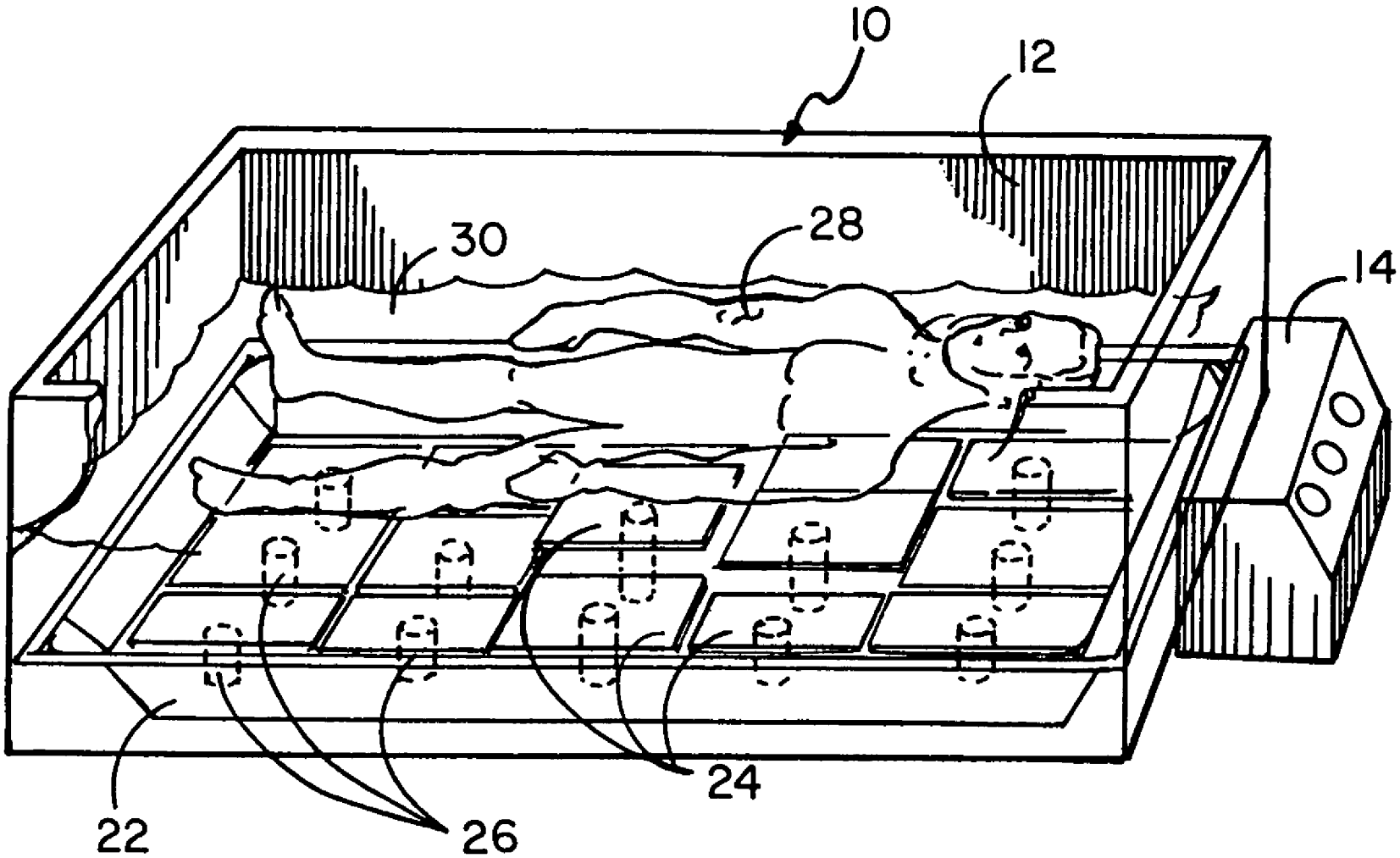
FIG. 1 illustrates a perspective view of the exercise bath of this invention showing the movable panels disposed under the bath's flexible bottom.
Figure 2:
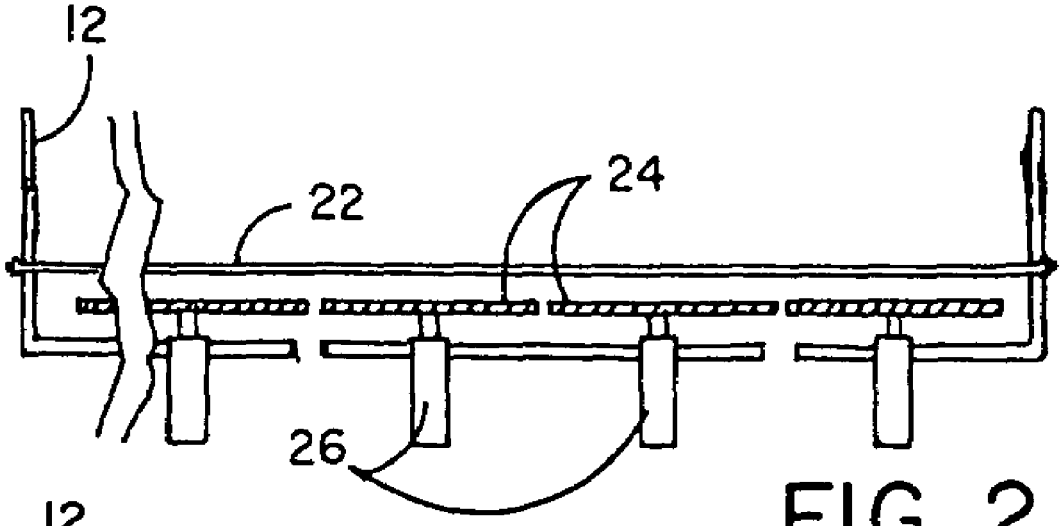
FIG. 2 illustrates a side cross-sectional view through a portion of an exercise bath with its panels in a non-advanced position and with no fluid in the bath.
Figure 3:
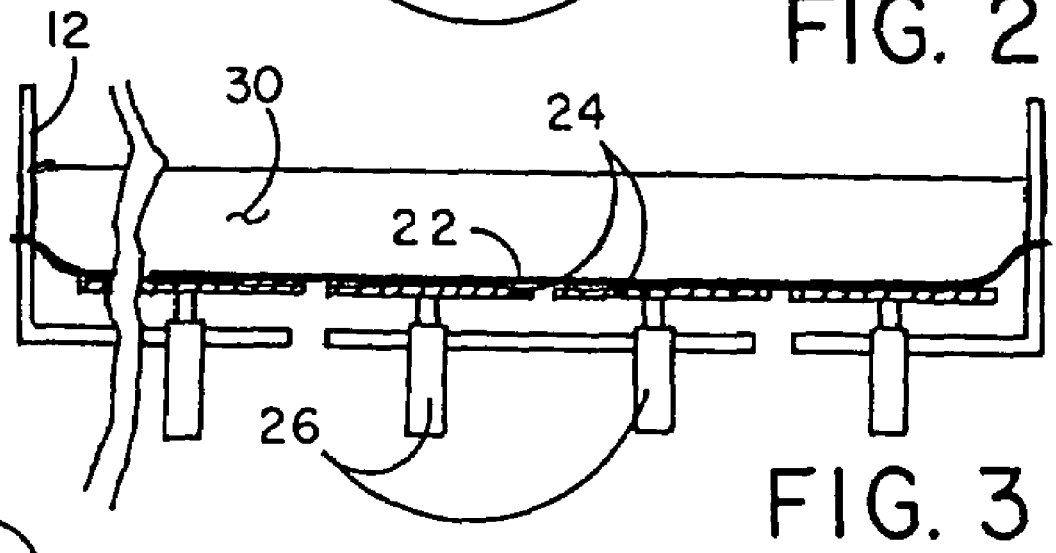
FIG. 3 illustrates a side cross-sectional view of the exercise bath of FIG. 2 with fluid added to the bath.
Figure 4:
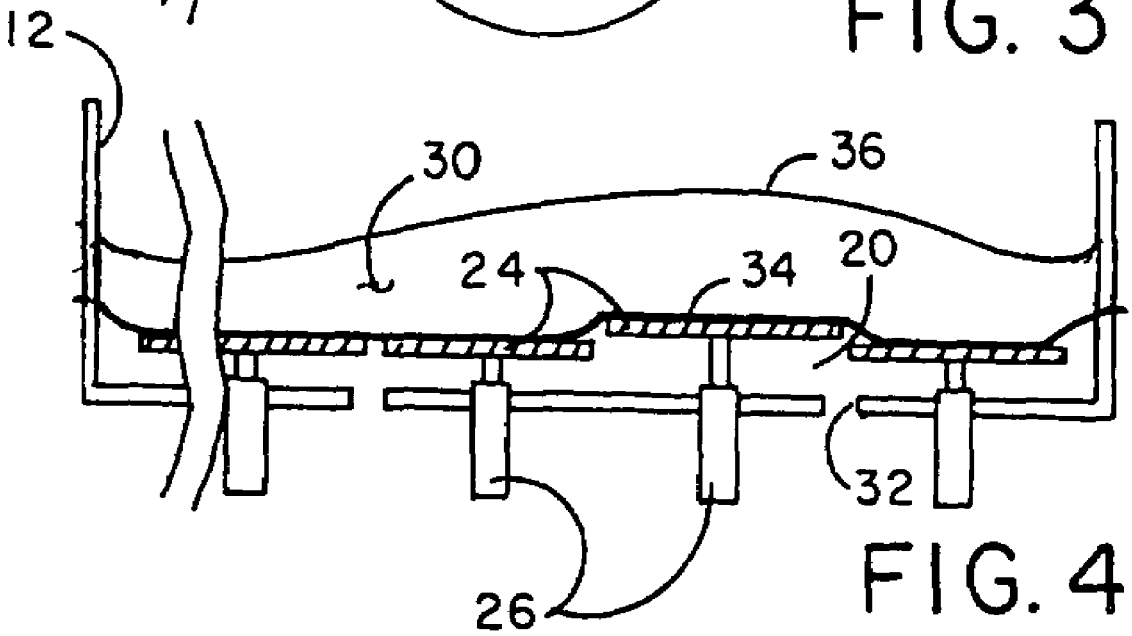
FIG. 4 illustrates a side cross-sectional view of the bath of FIG. 3 showing one of the panels in a raised position.

FIG. 1 illustrates an embodiment of the exercise bath of this invention wherein the bath has solid side walls 12, and a flexible bottom 22 under which are disposed a plurality of independently movable areas of movement also referred to as panels 24, each of which is interconnected to a cylinder 26 such that selected of said panels can be moved up and down under flexible bottom 22 so as to effect movement of fluid 30 during treatment of the user 28. By the use of movable panels, great amplitude of movement of fluid 30 can be accomplished. FIG. 2 illustrates a cross-section of a portion of the bath of FIG. 1 showing side wall 12 which engages flexible bottom 22 above a series of movable panels 24 which are moved up and down by cylinders 26. In FIGS. 3 and 4 fluid 30 has been added to the bath. The weight of the fluid deflects flexible bottom 22 downward to rest upon movable panels 24. FIG. 4 shows one of the movable panels 24 in a raised position 34 which action flexes and stretches flexible bottom 22 to push on fluid 30 and causes a wave 36 to develop in fluid 30. The movement of selected movable panels 24 can cause the formation of various desired wave patterns within the bath. Vents 32 can be provided to allow for air displacement in and out of chamber 20 when movable panels 24 move downward under flexible bottom 22. Flexible bottom 22 must be attached in a watertight fashion to side walls 12.

Figure 5:
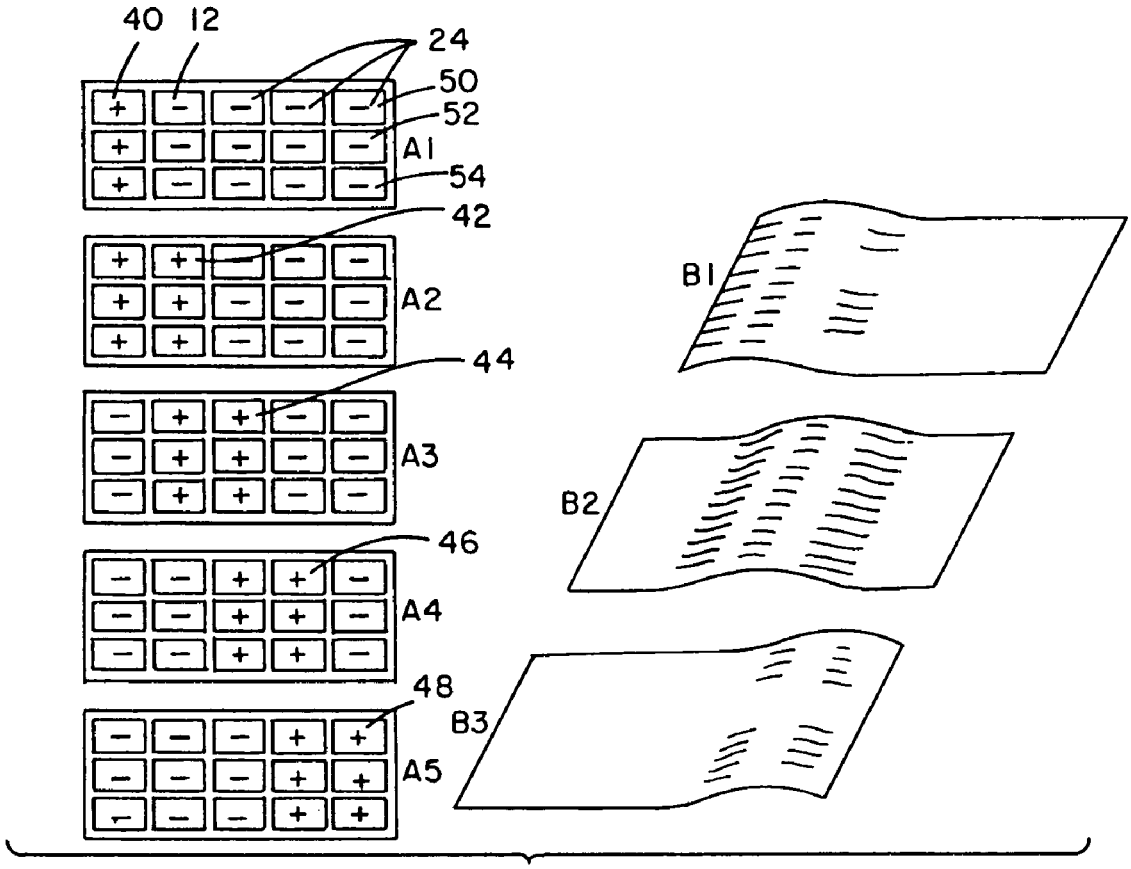
FIG. 5 illustrates the combination of a series of top views of arrangements of panels and isometric views of the respective wave surfaces produced by sequencing such panel arrangements.

FIG. 5 illustrates a series of top views of the panel arrangement within a bath designated $A^1$-$A^5$. Seen in these views is a plurality of panels 24. Those panels having a plus sign on them are biased upwards and those having a negative sign on them are not raised. By sequencing the movement of the panels, different wave patterns can be created in the bath. For example, in the bath with the panel arrangement designated as $A^1$, all three of the panels in first column 40 have a plus sign on them and are biased upwards while all the remaining panels are not raised. This sequence will start a wave along the length of the bath. In depiction $A^2$, second column 42 of panels is raised which creates a wave form, such as designated by the wave $B^1$. In depictions $A^3$ and $A^4$, the wave form is moved through the bath by the sequentially raising columns of panels, such as in third and fourth columns 44 and 46 while the first and second columns 40 and 42 are moving downward so as to create a moving wave, such as depicted by wave form $B^2$. In depiction $A^5$ the rightmost fourth and fifth columns 46 and 48 of panels are biased upwards, causing the wave form $B^3$. By sequencing the panels in various arrangements, a variety of wave forms can be created within the bath. The amplitude of the waves is affected by how high each panel is raised, and the frequency of the waves is in part dependent upon how fast the panels are raised and lowered.

Figure 6:
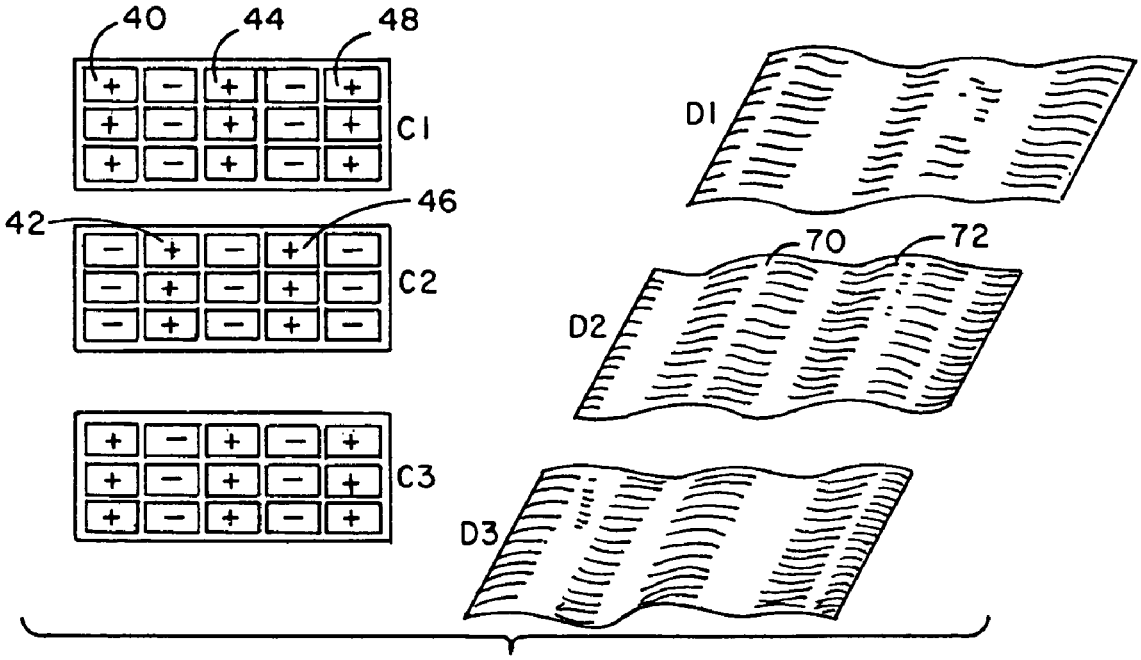
FIG. 6 illustrates the combination of a series of top views of alternate arrangements of panels and the isometric views of respective wave surfaces produced by sequencing such panel arrangements.
Figure 7:
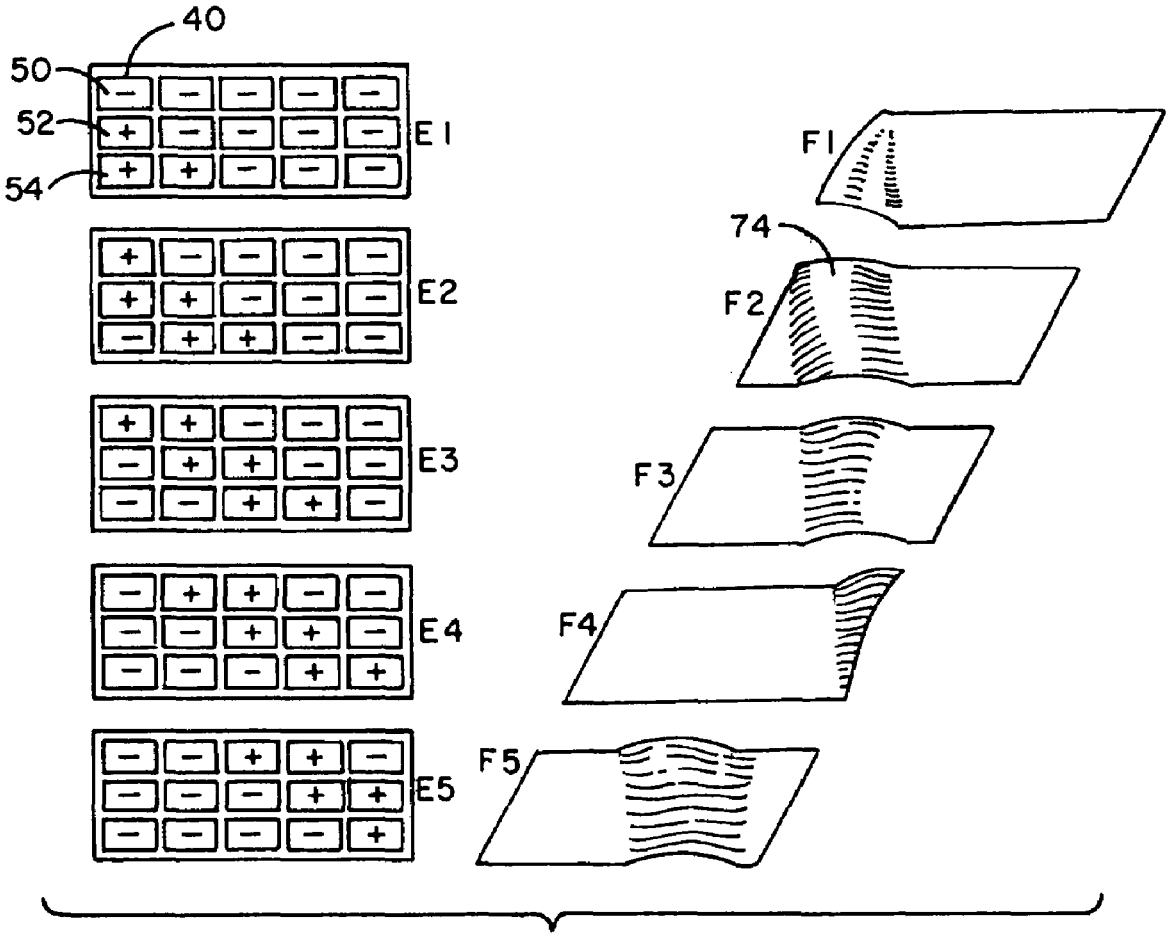
FIG. 7 illustrates the combination of a series of top views and isometric views of further alternate arrangements of panels and the respective wave surfaces produced by sequencing such panel arrangements.
Figure 8:
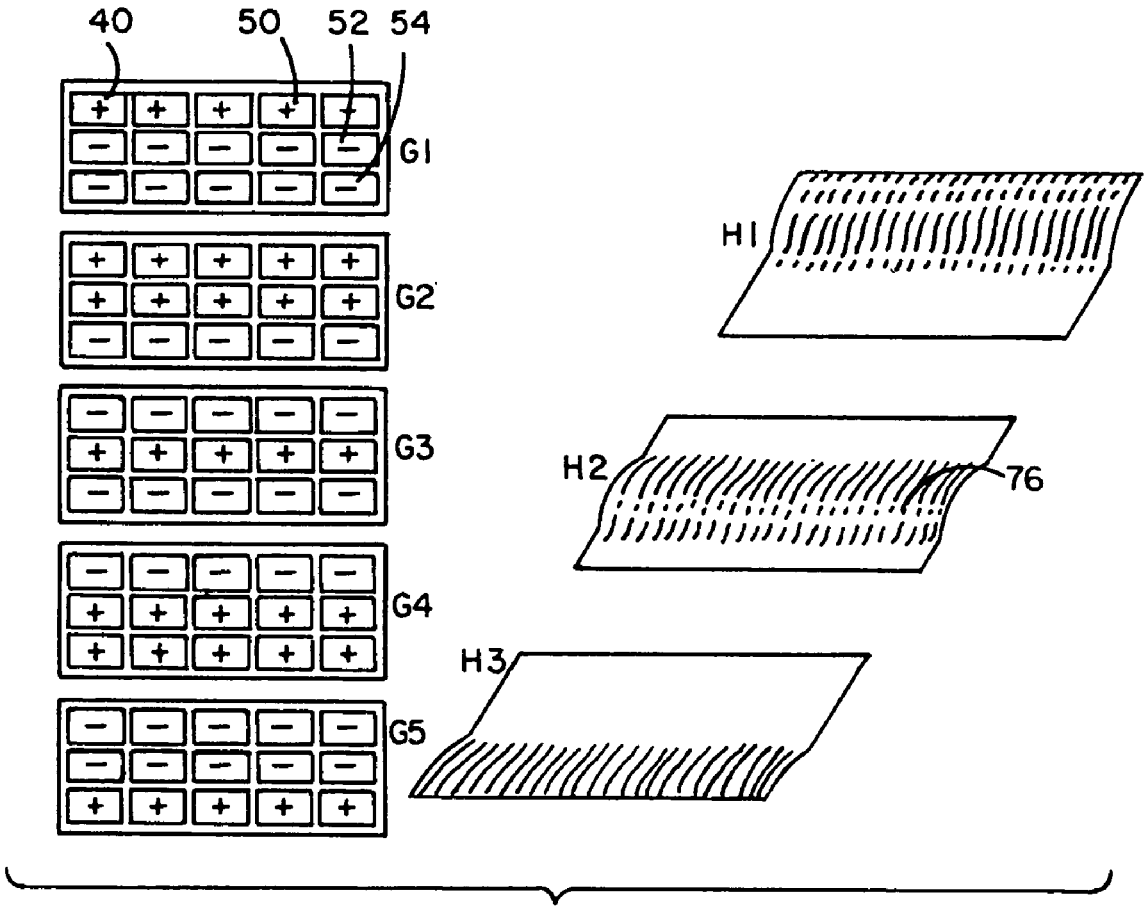
FIG. 8 illustrates the combination of a series of top views and isometric views of yet further alternate arrangements of panels and the respective wave surfaces produced by sequencing such panel arrangements.

FIGS. 6, 7 and 8 illustrate examples of various panel sequences to produce different wave forms in the bath. In FIG. 6 alternate columns of panels are raised and lowered, producing a series of wave forms having multiple crests within the bath as seen in wave forms $D^1$ and $D^3$ having multiple crests 70 and 72. In FIG. 7 the panels are raised at an angle sequentially within first, second and third rows 50, 52 and 54 to create a wave 74 running at an angle across the surface of the bath and back again, as depicted by wave forms $F^1$-$F^5$. FIG. 8 illustrates an alternate panel sequencing arrangement whereby the panels are raised and lowered by entire rows to create a wave pattern 76 running the width of the bath from one side to the other. The different sequencing of panel movement can be controlled by controller 14, shown in FIG. 1, and operated either by the user of the bath or by a therapist operating the exercise device. It should be noted that the wave patterns can include very long waves being a foot or more in length or very large waves being from several inches in height to more than 1 foot high such that the user may be unable to grab hold of two sides of the bath but may only be able to hold onto one of the sides during use. Because of the size of some users, they may be unable to hold the sides of the bath and may have to push against the sides in an attempt to maintain their position within the bath. Some baths can be so large that a user cannot reach the side walls during use. The body type and size of the user of the bath must be considered in determining the water level and wave size to be used. The water level in the bath must be higher than the largest wave height desired. The density of the human body is approximately 1.0 or about equal to that of water so that when a user lies down in the bath, the user displaces water, causing the water level in the bath to rise. Generally to allow proper operation where the lowest body part is submerged, a minimum of a few inches of water is needed between the flexible bottom and the body of the user. When wave action is occurring in the bath, there exist zones of high depth and low depth of water. The amount of water in the bath can be adjusted in height so that no part of the body touches the flexible bottom which situation helps to cause the user to struggle to maintain equilibrium against the wave action for passive exercise or physiotherapy benefits. In some cases the upper surface of the flexible bottom can be of low friction, slippery or lubricious material and/or the fluid can be of an oil-like material that is slippery. The device even with a very small amount of fluid therein, such as less than 1 inch, can be used to provide massage to the user for a variety of therapeutic treatments. Such treatments are beneficial for "failure to thrive" infants suffering from lack of maternal handling. The anthropomorphic measurements of the user and other properties of the bath including their size, mass, length, width, height, depth, perimeter and the user's strength and joint mobility are all important when an operator is selecting the approximate water depth and wave current action or pattern sequence of the panels. The operator must take into account the weight and body fat of the user to best determine the amount of water and force needed for the regulation of the panel motive devices. For example, in a pneumatic system, the amount of air pressure needed must be determined for the pneumatic cylinder to drive the panel upwards, raising the column of water above it along with the body of the user.

Figure 9:
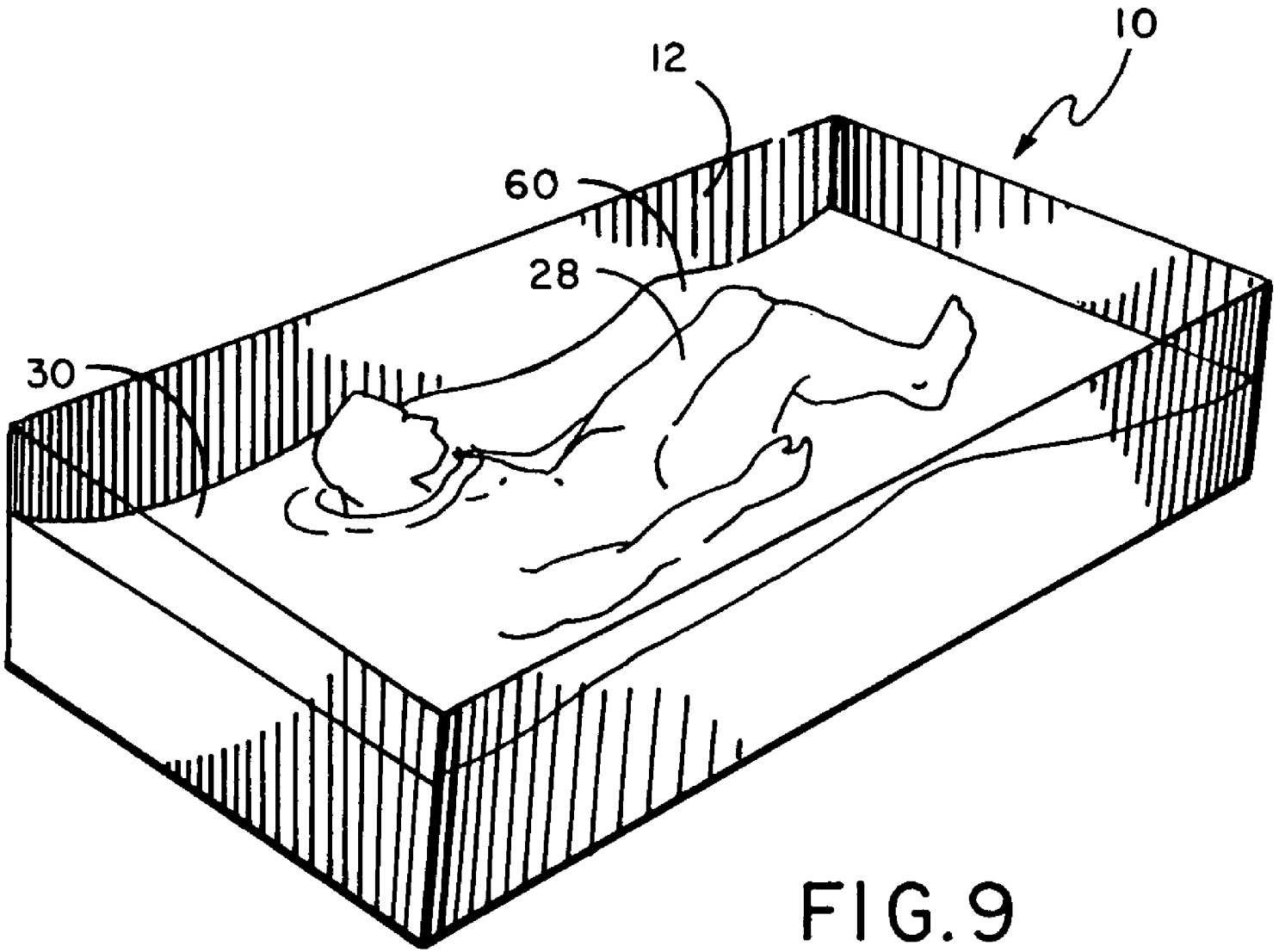
FIG. 9 illustrates a perspective view of the exercise bath of this invention with a user positioned therein showing a wave crest at a first position.
Figure 10:
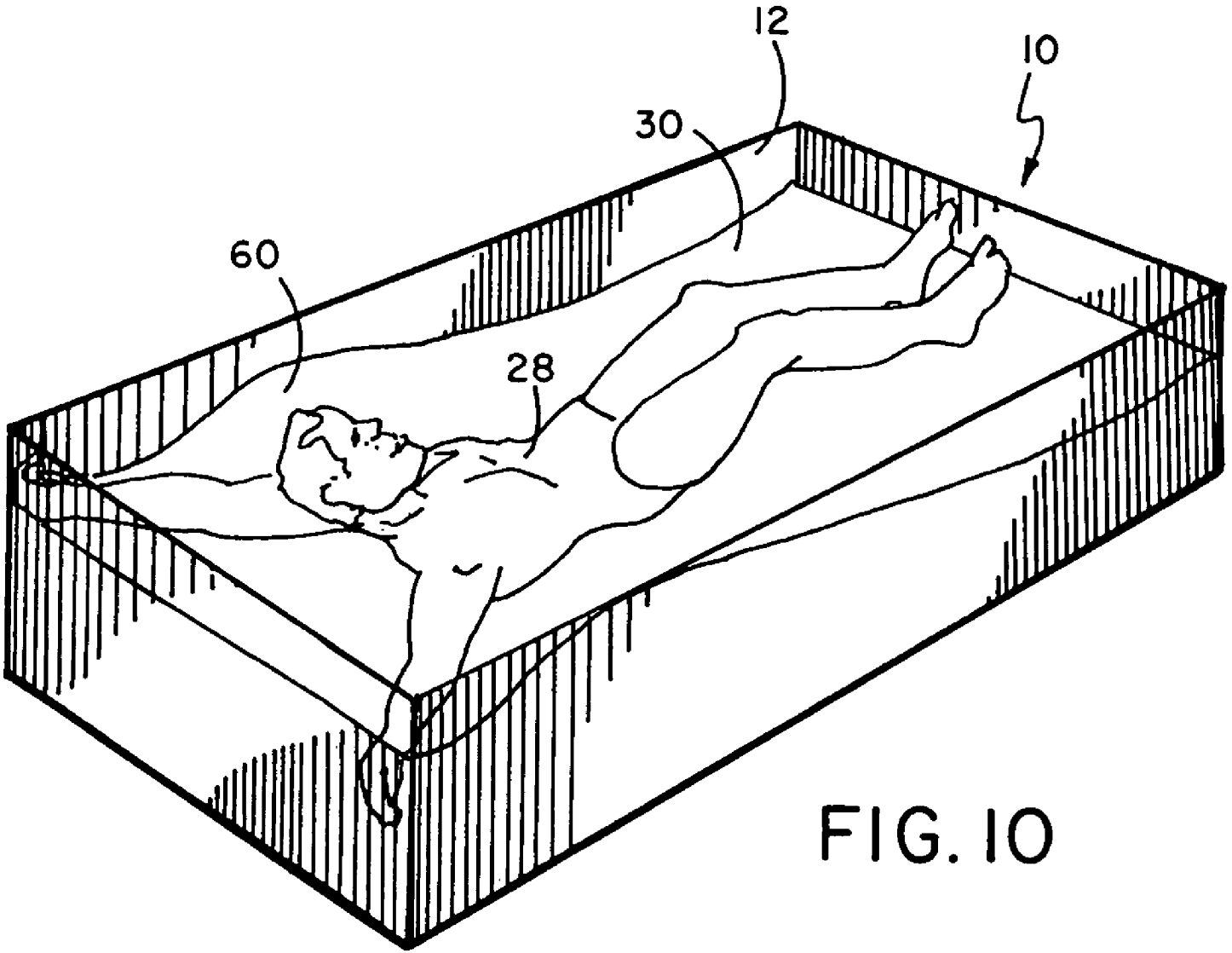
FIG. 10 illustrates a perspective view of the exercise bath of FIG. 9 showing the wave crest at a second position and showing movement of the user to maintain his balance and thereby exercising his body.

FIG. 9 illustrates bath 10 of this invention with user 28 therein, showing wave crest 60 formed in the bath near the user's knees. As the panels under the bath, which are not seen in FIGS. 9 and 10, move through their preselected sequences, waves are formed and move in the bath, such as seen in FIG. 10 where wave crest 60 has moved to a position near the chest of user 28 who has moved his arms upward to support himself from being submerged from the wave action, thus exercising within bath 10.

It should be noted that many different fluids can be utilized within the bath of this invention. The temperature of the fluid in the bath can be provided by heating units disposed within the bath which heating units are well known in the art and can be comfort or treatment related. The adjustment of the heating units can be accomplished by means of the control panel. The heat adjustment can be thermostatically controlled through a fluid recirculation to maintain a desired temperature.

In some instances it may be desirable to provide an ice maker, a bubble producer, a mister, music and/or recirculation heater which can all be controlled by control panel 14.

Figure 11:
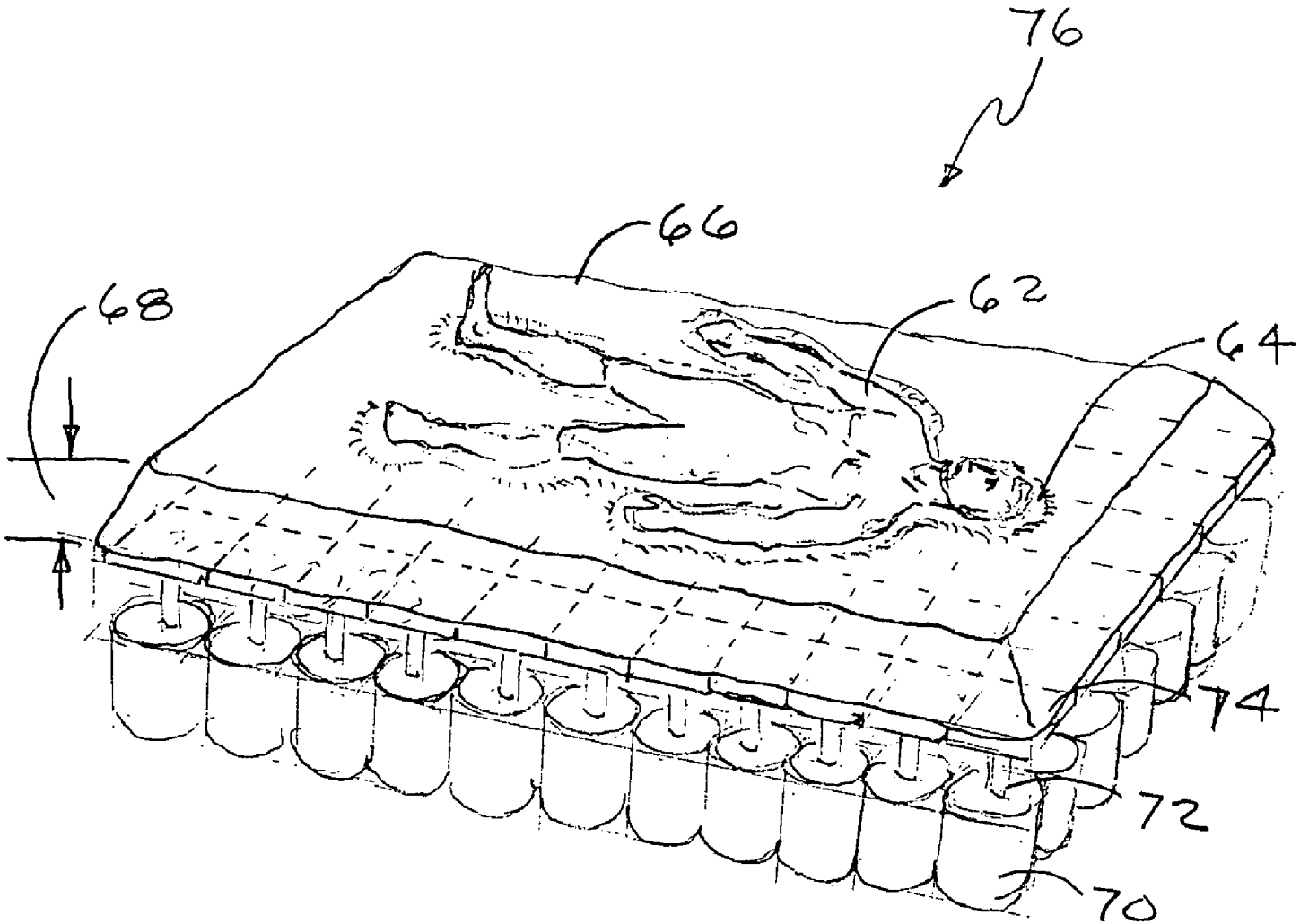
FIG. 11 illustrates a perspective view of the embodiment of the invention not utilizing fluid but having a resilient pad disposed under the user.

In some embodiments a dry version of bath 76 seen in FIG. 11 can be utilized by providing a pad 66 that contains a fluid or fluid-like material with sufficient depth 68 for a user 62 to sink therein in some cases to form a user receipt indentation 64. In other instances the user will not sink into the pad. The bath functions, as does the embodiment seen in FIG. 1, with motive devices 70 forcing piston shafts 72 up and down, moving dry bath panels 74 in a desired sequence under pad 66. Pad 66 can be hollow to contain fluid-like material, including slurries that in some embodiments can include clay-like materials or other equivalent fluid-like materials. One material that can function in the pad at many different levels of viscosity is silicon gel which can be utilized from a hard, sticky consistency to a soft, gelatin-like consistency. When the material in the pad is soft, the user will sink into the pad, as shown in FIG. 11; and when the material in the pad is stiff, the pad will provide sharper, snappy movements to the body of the user.

Figure 12:
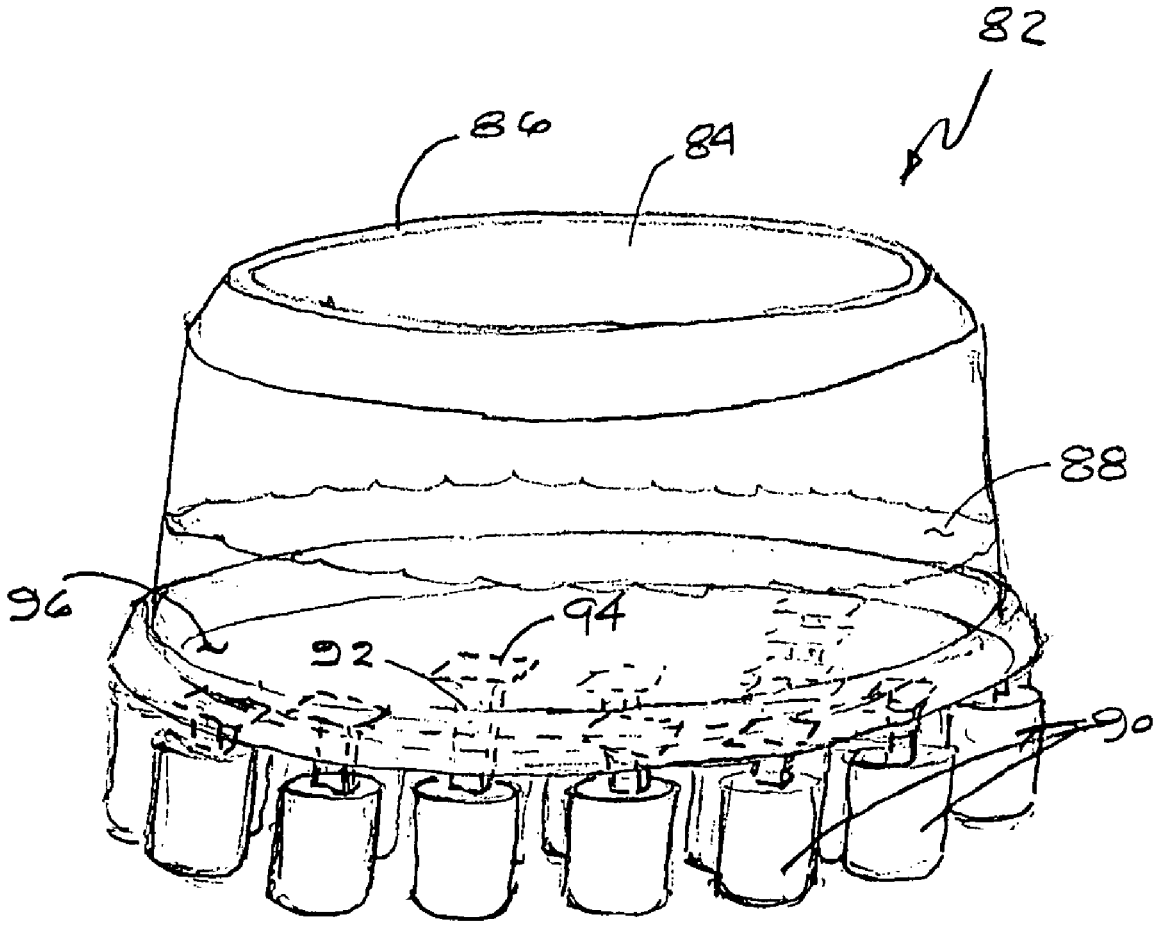
FIG. 12 illustrates a perspective view of the bath of this invention in a circular form.

The exercise bath of this invention can not only be rectangular in shape, but also can take other shapes such as round bath 82 seen in FIG. 12 which contains round bath fluid 88 above a round bath flexible bottom 96. Round bath flexible bottom 96, as well as membranes in the embodiments of FIG. 1, can be made of a rubber sheet of 3/16 inch red medical-grade silicon. In some bath embodiments the flexible bottom can take the form of a ½ inch thick foam rubber sheet or equivalent flexible material. The flexible bottom can be coated with a slippery material on its bottom such as Teflon or an oil lubricant to make it lubricious so that it slides easily over the moving panels thereunder. Also seen in FIG. 12 is an alternate shaft being round bath square shaft 92 seen extending from round bath motive devices 90 to round bath panel 94. It has been found that because the weight of the fluid in the bath is so great, some cylinders having round shafts can undesirably rotate in operation; and the use of a square shaft prevents such undesirable rotation which square shafts can also be used in the other embodiments of the bath. The weight of the water above a pad differs with the depth of the water but with a pad of 13 inches X 17 inches dimension having a surface area of 221 square inches and with the density of water being 0.03613 lb./cubic inch, the weight above a column of a 10 inch water depth bath is 79.8 lb.; of a 15 inch water depth bath, 119.9 lb.; and of a 20 inch water depth bath, 159.7 lb. These heavy weights mean that each cylinder must produce high levels of force to create the desired wave movement.

Figure 13:
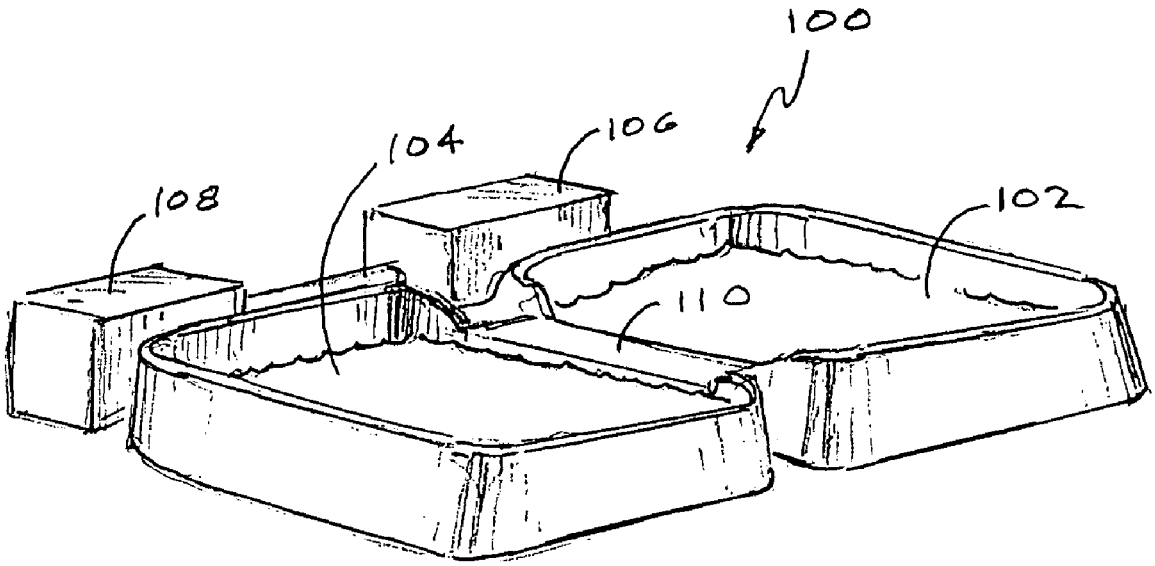
FIG. 13 illustrates a perspective view of the bath of this invention having dual chambers side by side with an access separator disposed between the two chambers.

FIG. 13 illustrates a hot and cold dual bath system 100 wherein the cylinders and panels, which are disposed under the baths, are not seen. The user can move from a hot bath such as first bath 102 over a lower junction wall 110 to a cold second bath 104. A circulating pump 106 can be utilized in conjunction with a heater/cooler 108. This type of dual bath system 100 allows the user to choose a hot or cold bath and to move therebetween easily since junction wall 110 is lower than the other walls of the baths. The user can easily maneuver himself or herself thereover since the water levels are high and the user can remain in a prone position while going from one bath to the other. Such hot and cold dual bath system can find usage within steam or sauna rooms. Since the fluids in each bath are at different temperatures, it is desirable that not mixing occur so that such temperatures can be maintained. To that end, a waterproof sheet of material can be positioned above the junction wall and joining with it in a watertight relationship which sheet can be pushed out of the way during passage of the user moving from one bath to the other. Dual sheets adjacent to one another can also be utilized with the user passing through the center junction.

Figure 15:
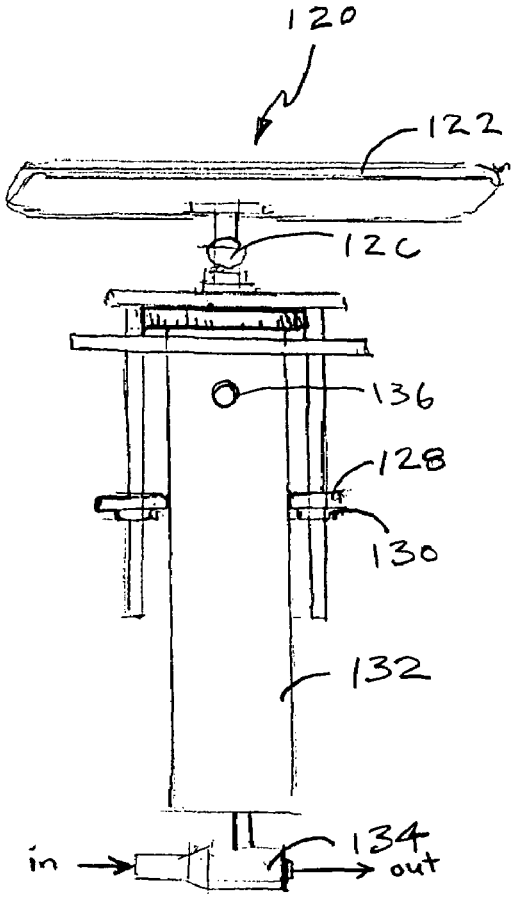
FIG. 15 illustrates a side perspective view of a cylinder having an anti-rotating mechanism in a retracted position.
Figure 14:
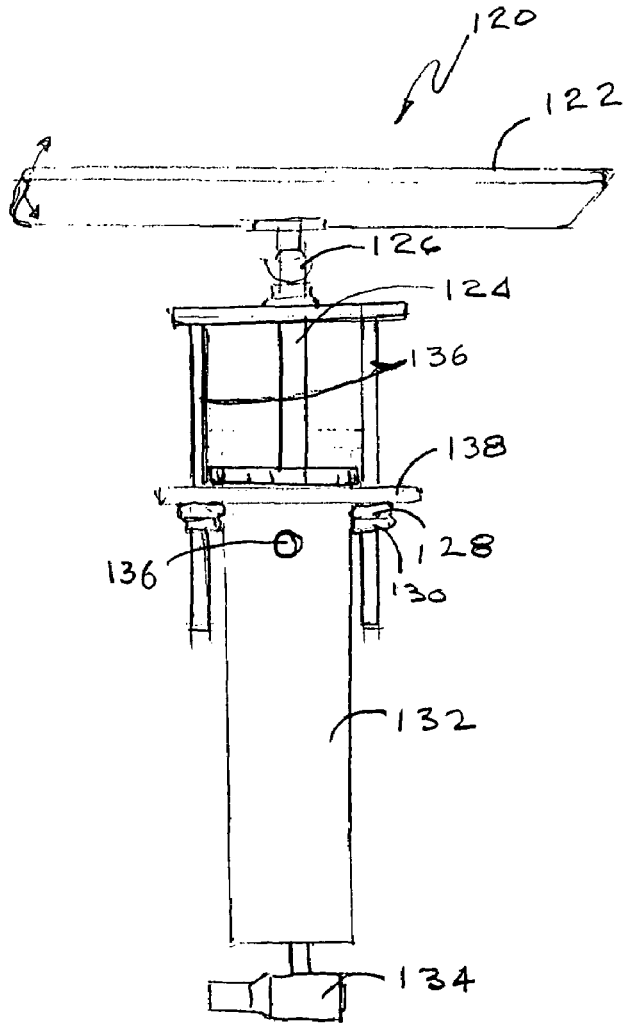
FIG. 14 illustrates a side perspective view of a cylinder having an anti-rotating mechanism in an extended position.

FIGS. 14 and 15 illustrate typical motive devices being a pneumatic cylinder 12 being disposed under panel 122 which is mounted on piston shaft 124. Since panel 122 must move to accommodate the angles of the flexible bottom, in some embodiments panel 122 is mounted on a movable universal joint 126. Piston shaft 12 is retained by a pair of anti-rotation rods 136 which prevent any rotation of the piston rods as such anti-rotation rods 136 pass through apertures in plate 138. In some embodiments noise suppression foam pads 128 can be utilized between collar stops 130 and plate 138 to reduce noise during operation. A quick release valve 134 can be provided to allow a fast intake and release of air therethrough from the weight of the water on the panel when cylinder 132 is not pressurized. Bleeder valve 136 provides an exit port when the piston in cylinder 132 is forced upward by pressure through the intake of valve 134. When air pressure is not present through the intake of valve 134, then air can quickly exit through the air release of valve 134 outward for quick up and down action of cylinder 12.

The present invention has been described with reference to particular embodiments, it will be apparent to those skilled in the art that variations and modifications can be substituted therefor without departing from the principles and spirit of the invention.

I claim:

1. A fully body exercise device for use by a user, comprising:

a bath having side walls and a bottom, said bottom having a plurality of separately movable panels therein and a watertight flexible member resting on said plurality of separately moveable panels, said plurality of separately moveable panels being adapted to produce low-frequency, large amplitude wave movement of a volume of fluid in said bath above said flexible member and slosh said fluid in a variety of wave patterns against said user who has a proprioceptive reaction and must move his body and exercise to maintain his balance within said bath from the force of said wave movement; and means to move each of said panels, each panel when moved displacing fluid above said flexible member for creating said low-frequency, large amplitude wave movement of said fluid within said bath.

2. The device of claim 1 wherein said means to move said panels include a plurality of cylinders, each disposed under one of said panels, each of said cylinders moving a panel upwards and downwards when selectively moved for creating wave movement of said fluid in said bath.

* * * * *